US005375920A

United States Patent [19]

Macchi Cassia

[11] Patent Number: 5,375,920

[45] Date of Patent: Dec. 27, 1994

[54] HANDTOWEL DISPENSER

[75] Inventor: Antonio Macchi Cassia, Milan, Italy

[73] Assignee: Groupement d'Interet Economique Elis, Puteaux, France

[21] Appl. No.: 27,172

[22] Filed: Mar. 16, 1993

[30] Foreign Application Priority Data

Jan. 18, 1991 [FR] France ..... 91 00555

[51] Int. Cl.[5] ..... A47K 10/00

[52] U.S. Cl. ..... 312/34.17; 312/34.12

[58] Field of Search ..... 312/34.11–34.17

[56] References Cited

U.S. PATENT DOCUMENTS

| | | | |
|---|---|---|---|
| 2,709,121 | 5/1955 | Morris . | |
| 3,971,607 | 7/1976 | Schnyder | 312/34.12 |
| 4,270,818 | 6/1981 | McCabe | 312/34.12 |
| 5,244,263 | 9/1993 | Kennedy | 312/34.11 |

FOREIGN PATENT DOCUMENTS

| | | |
|---|---|---|
| 0172667 | 2/1986 | European Pat. Off. . |
| 0202078 | 11/1986 | European Pat. Off. . |
| 0330553 | 8/1989 | European Pat. Off. . |

*Primary Examiner*—Stephen C. Pellegrino
*Assistant Examiner*—Nancy Mulcare

[57] ABSTRACT

In this dispenser, the housing (1) is divided by means of a separation partition (9) into a lower compartment (12) containing a roll of clean towel (28) and an upper compartment (11) containing a shaft (45) around which the strip of used towel is wound under drive from a drive roller (49). The front wall (4) of the housing includes a lower portion (4*a*), whose top edge (4*c*) co-operates with an outside extension (9*b*) of the partition (9) to form an outlet slot (14) for the strip of towel, and an upper portion (4*b*) which is movable to give access to the upper compartment (11) and whose bottom edge (4*d*) co-operates with the extension (9*b*) to form an inlet slot for the strip of towel. Two feed rollers (31, 32) placed in the outlet slot (14) are respectively supported by the partition (9) and by the lower portion (4*a*) of the front wall (4), one of which rollers is movably mounted relative to the other to give access to the lower compartment (12) of the housing.

20 Claims, 4 Drawing Sheets

HANDTOWEL DISPENSER

The present invention relates to a handtowel dispenser, in which a predetermined length of clean towel strip is extracted on request through a first slot of the dispenser housing, and is subsequently "swallowed" after use, back into the housing through a second slot therein.

Numerous handtowel dispensers are already known. In some known dispensers, for example such as those described in French patent 2 178 168, in German patent 1 130 128, in U.S. Pat. Nos. 2,202,930, 2,939,754, 3,826,548, 4,573,750, and 4,718,588, and in International patent application WO 87/03463, the strip of clean towel is extracted from the housing of the dispenser by manually exerting traction on the portion of the strip of towel that is exposed outside the housing. In such known dispensers, the strip is "swallowed" into the housing after use by means of a wind-up mechanism including an electric motor or a system for accumulating energy, which is cocked by the motion of the strip of clean towel under the effect of the manual traction force exerted thereon. After a predetermined time lapse defined by a delay mechanism, the electric motor or the system for accumulating energy is activated to wind up the strip of used towel.

In other known handtowel dispensers, e.g. as described in French patent 2,169,295, and in U.S. Pat. Nos. 3,797,902, 3,951,485, 3,971,607, and 4,676,559, the operation of extracting the strip of clean towel from the housing of the dispenser and the operation of returning the strip of used towel into the dispenser are performed entirely automatically by means of two electric motors controlled by a suitable sequential control system.

In all of the known handtowel dispensers described in the above-mentioned documents, loading the dispenser with a roll of clean towel, and in particular threading the starter strip of clean towel to the wind-up shaft and installing it thereon are relatively complicated. Under all circumstances it is necessary to pass the starter strip through at least one passage that has the feature of being narrow and/or long and/or sinuous and/or difficult of access, such that it is relatively difficult and in any event awkward to cause the starter strip of generally soft towel to pass along said passage. In addition, in all known dispensers, if a breakdown occurs in service while the roll of clean towel has not been fully used, e.g. because of the towel jamming or because of a mechanical failure, it is impossible to remove the roll of clean towel and the roll of used towel from the housing without it being necessary either to unwind the towel completely from one or other of the rolls, or else, where possible, to remove at least one part or set of parts that is normally mounted in a fixed position and that is not designed to be moved or removed in normal service. In addition, in some cases, when the towel wind-up shaft has one of its ends connected to a rotary drive mechanism, it is necessary to provide a detachable coupling device between the drive mechanism and the corresponding end of said shaft. The need to undo this coupling in order to be able to remove the roll of used towel, when ready, and the need to re-establish said coupling after the starter strip of a new roll of clean towel has begun to be wound onto the shaft further complicates the operations of preparing the dispenser prior to use.

Most of the known dispensers described in the above-mentioned documents raise problems of hygiene. This applies in particular with dispensers where the user has to exert manual traction on the strip of towel, since there is no way of being certain that the piece of towel that the user grasps for pulling down has not already been contaminated, given that it is freely accessible. It is true that attempts have been made to solve the problem due to a loop of towel being present outside the dispenser housing by providing for said loop to be recovered automatically after each use. However, even after such automatic recovery, there still remains a length of towel beneath the dispenser and under greater or lesser tension that is relatively visible and that is certainly still visible from the outside and capable of being dirtied subsequently. In addition, the outer lower portion of the dispenser remains continuously in contact with damp and dirty towel. It sometimes also happens that recovery is performed in such a manner that when the user exerts traction on the towel, the loop that is formed presents not only a length of clean towel facing the user, but also a length of used towel behind the length of clean towel. Finally, in most known dispensers, it is never certain that the roll of clean towel has been kept completely separate from the roll of used towel, essentially because of the complicated path followed by the towel, which path is considered by some as being a hygiene danger because the roll of used and thus dirty towel lies underneath the roll of clean towel.

These hygiene problems are solved in part by the dispenser described in U.S. Pat. No. 4,676,559, since the housing thereof has a separating partition which isolates the roll of clean towel from the roll of used towel, and since both of the slots through the housing are to be found in the lower portion of the housing and are relatively close together, such that the portion of the strip of towel that remains exposed outside after each occasion that the strip of used towel has been wound up is relatively short compared with other known dispensers. However, in the dispenser of U.S. Pat. No. 4,676,559, there remain the problems mentioned above relating to the difficulty of installing the starter strip when loading the dispenser with a new roll of clean towel, the difficulty of removing the roll of clean towel and the roll of used towel in the event of a breakdown while the roll of clean towel has not been completely used up, and the need to undo the coupling between the used towel wind-up shaft and its drive mechanism in order to remove the roll of used towel, and of re-establishing said coupling after a new roll of clean towel has been installed.

An object of the present invention is thus to provide a handtowel dispenser of the type that comprises, like the dispenser of U.S. Pat. No. 4,676,559: a housing having a top wall, a bottom wall, and four vertical walls, one of which is designed to be fixed to a vertical support surface, a separation partition that separates the inside volume of the housing into an upper compartment and a lower compartment, a roll of clean towel disposed in the lower compartment, a shaft mounted to rotate in the upper compartment, a pair of cooperating feed rollers disposed in the lower compartment to unwind a predetermined length of clean towel strip from said roll of clean towel and to cause it to pass to the outside of the housing through a first slot therein, first drive means connected to one of the two feed rollers to rotate it in response to a start signal, second drive means co-operating with said shaft to pull said strip of towel into the housing through a second slot therein after said strip of towel has been used, and to cause it to be wound about said shaft after a predetermined time lapse from the start signal, the housing including at least one movable access portion which is detachably fixed to the remainder of the housing to enable the roll of used towel to be removed and to enable a new roll of clean towel to be installed.

In particular, an object of the present invention is to provide a handtowel dispenser of the above-specified type, in which the operation of removing the roll of used towel after the roll of clean towel has been used up, the operation of loading the dispenser with a new roll of clean towel, and the operations of removing both rolls of towel in the event of a breakdown occurring before the roll of clean towel has been completely used up, can all be performed in a manner that is very simple and very quick.

To this end, the dispenser of the present invention is characterized in that a first one of the four vertical walls of the housing includes a lower portion and an upper portion that are spaced apart from each other, in that the first slot is delimited by the top edge of the lower portion of said first vertical wall and by an extension of the separation partition which projects outside the housing, while the second slot is delimited by the bottom edge of the upper portion of said first vertical wall and by said extension of the separation partition; in that said movable access portion is formed at least in part by said upper portion of the first vertical wall; in that the second drive means comprise a drive roller having a non-smooth surface which is rotatably mounted above the separation partition, and a motor which is drivingly connected to said drive roller; in that said shaft is made of a heavy material, is disposed above said drive roller and has its ends mounted to slide and rotate freely in guide grooves which are formed respectively in second and third vertical walls of the housing adjacent to said first vertical wall and which extend in a generally downwards direction to the vicinity of the ends of the drive roller; and in that the two feed rollers are located in the first slot and are supported by two separate portions of the housing; one of which portions forms another movable access portion that can be displaced from a first position in which, in operation, the two feed rollers are pressed against opposite faces of the strip of clean towel, and a second position in which the two feed rollers are widely spaced apart from each other to give access to the lower compartment of the housing.

By means of such an organization, and as appears more clearly from the detailed description given below, the operations of removing the roll of used towel and of installing a new roll of clean towel become very simple and very quick. In addition, in the event of a breakdown or incident that takes place while the roll of clean towel in the lower compartment has not been used up completely and while a certain quantity of used towel has already been wound into the upper compartment, and requiring both rolls to be removed in order to repair the breakdown, it is possible to remove both rolls quite simply by opening the two moving portions giving access to the housing, without there being any need to disassemble any other portion of the dispenser, and without it being necessary to unwind either of the two rolls in full.

It is true that certain aspects of the dispenser of the present invention are known per se from the Applicant's prior European patent application 0 330 553. In the dispenser known from said prior patent application, the two slots or passages through which the strip of towel leaves the housing and returns therein, respectively, are formed in the same vertical wall of the housing as in the dispenser of the present invention. However, unlike the dispenser of the present invention, in that known dispenser the roll of clean towel is disposed in the upper compartment in order to improve the hygiene characteristics of the dispenser, while the roll of used towel is in the lower compartment and is carried by a shaft having one of its ends coupled to a drive mechanism. Although such a known dispenser has hygiene characteristics that are clearly improved over other known dispensers of the same kind, experience has shown that in operation the dispenser of European patent application 0 330 553 is frequently subject to towel jams both in the outlet passage and in the inlet passage for the strip of towel. For various reasons, the outlet passage for the strip of towel must be relatively narrow (as measured in the thickness direction of the strip of towel) and cannot be modified to any great extent without going against the reasons that require it to be narrow. Because of this narrowness, and because strips of towel often have stitching of a thickness that can vary within a single roll or from one roll to another, it sometimes happens that a stitch that is a little too thick hinders free movement of the strip of towel through the outlet passage, by rubbing against the opposite walls thereof, thereby giving rise to jamming. Such jamming can also occur if the user presses for too long a period off time against the ON button of the dispenser (button 41 in FIG. 1 of European patent application 0 330 553). As for jamming in the inlet passage, it takes place essentially due to the fact that the two portions of the loop of towel that hang outside the dispenser in operation are very close together. As a result, when a user wipes the hands, there is a tendency for both pieces of the loop to be grasped simultaneously, such that the two pieces tend to be crumpled together and they tend to stick together because of the moisture, thereby preventing the strip of towel being taken in properly through the inlet passage when the wind-up shaft is rotated. Finally, because the wind-up shaft has one of its ends coupled to a drive mechanism, a detachable coupling must be provided, and the operation of removing the roll of used towel from the housing of the dispenser is more complicated than it would be if the said shaft were merely mounted free to rotate inside the housing of the dispenser. All of those problems relating to the dispenser of European patent application 0 330 553 are resolved by the invention because the roll of clean towel and the roll of used towel are respectively disposed in the lower compartment and in the upper compartment of the housing, and because of the other characteristics taken together of the dispenser of the invention as specified above.

Other characteristics and advantages of the present invention appear more clearly from the following description of a preferred embodiment of the present invention, given with reference to the accompanying drawings, in which.

Figure 1:
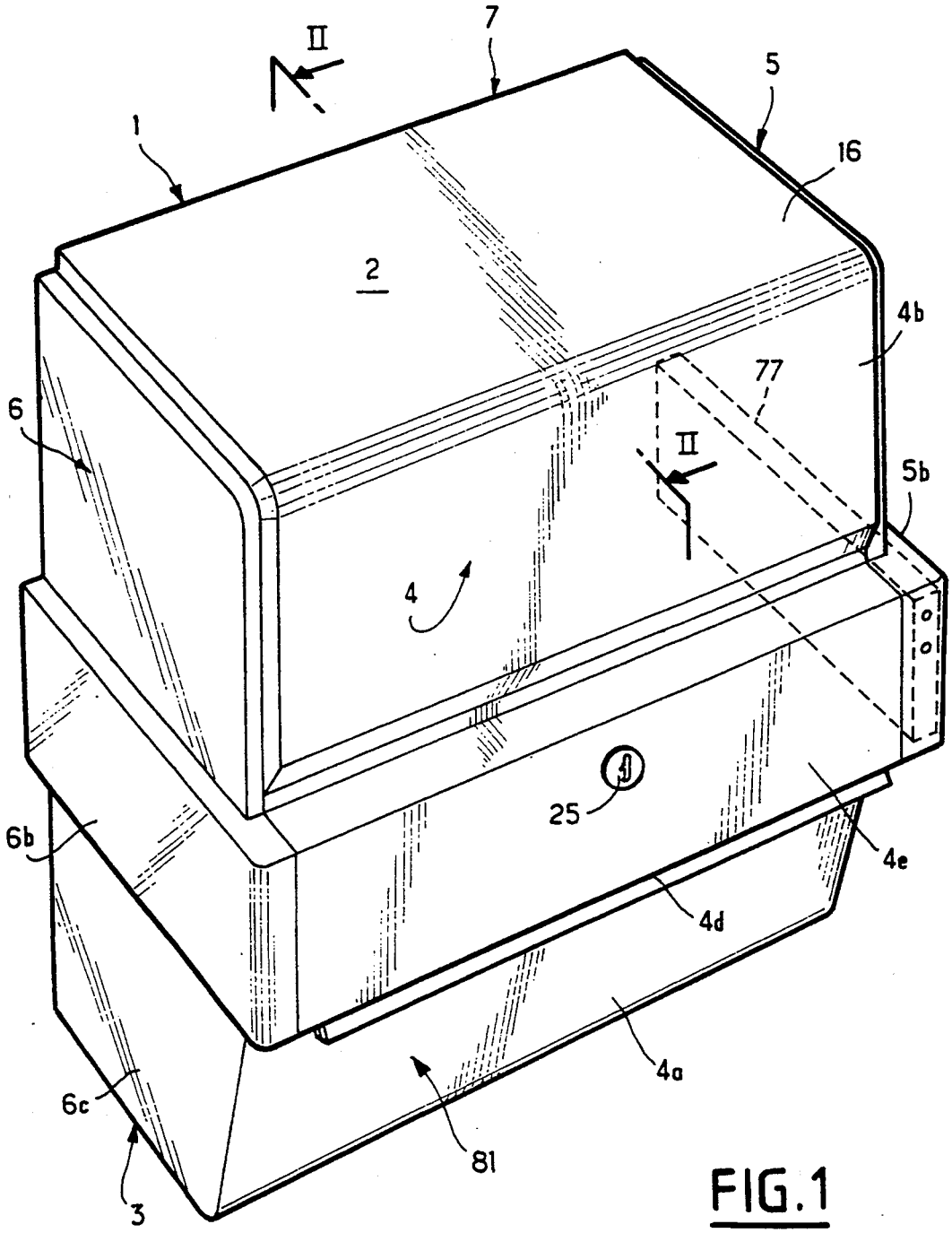
FIG. 1 is a perspective view of a handtowel dispenser of the invention.

The handtowel dispenser shown in the drawings comprises a housing 1 having a top wall 2, a bottom wall 3, and four substantially vertical walls 4, 5, 6, and 7. In the embodiment shown, where the wall 7 is the rear wall of the housing 1 designed to be fixed against a wall or some other support surface 8 (FIG. 2), the wall 4 is the front wall of the housing 1, while the walls 5 and 6 are the side walls thereof. Nevertheless, in another embodiment of the invention, the wall 5 or the wall 6 could be designed for fixing to a wall or some other support surface, with the walls 4 and 7 then extending perpendicularly to said support surface.

Figure 4:
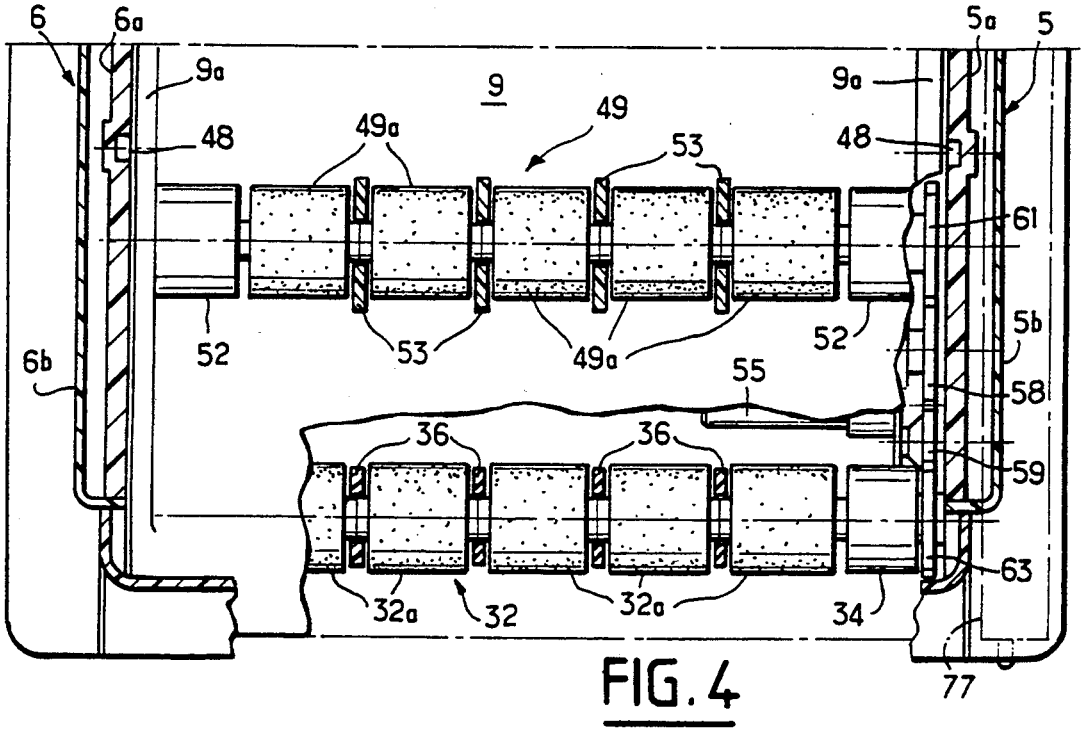
FIG. 4 is a partially cutaway section view on line IV—IV of FIG. 2, with some portions of the dispenser being removed.

A separating partition 9 which extends generally horizontally inside the housing 1 about halfway up it divides the inside volume of the housing into an upper compartment 11 and a lower compartment 12. The separation partition 9 is connected to the housing 1 by a horizontal-axis hinge-forming device 13 situated close to the wall 7 of the housing so that the rear edge of the separation partition 9 is as close as possible to said wall 7. The form of the separation partition 9 may, for example, be that of a tray having two lateral flanges 9*a*. The hinge-forming device 13 may be constituted, for example, by two bolts whose shanks include respective smooth portions that pass freely through holes formed in respective flanges 9*a* of the separation partition 9, and respective threaded portions screwed into tapped holes provided in each of two plates 5*a* and 6*a*. The separation partition 9 is thus hinged relative to the housing 1, and by unscrewing the two bolts 13, it may optionally be removed from the housing, should that be desired. The two plates 5*a* and 6*a* form portions of the side walls 5 and 6 respectively, and they are integrally formed with the rear wall 7, forming, together therewith, a loadcarrying structure. The elements 5*b* and 6*b* shown in FIGS. 1 and 4 are bodywork elements fixed to the plates 5*a* and 6*a*, respectively.

The front wall 4 includes a lower portion 4*a* and an upper portion 4*b*. A first slot 14 is formed between the top edge 4*c* of the lower portion 4*a* of the front wall 4 and an extension 9*b* of the separation partition 9 that projects towards the outside of the housing 1 beyond the lower portion 4*a* of the front wall 4. A second slot 15 is also formed between said extension 9*b* and the bottom edge 4*d* of the upper portion 4*b* of the front wall 4.

Figure 2:
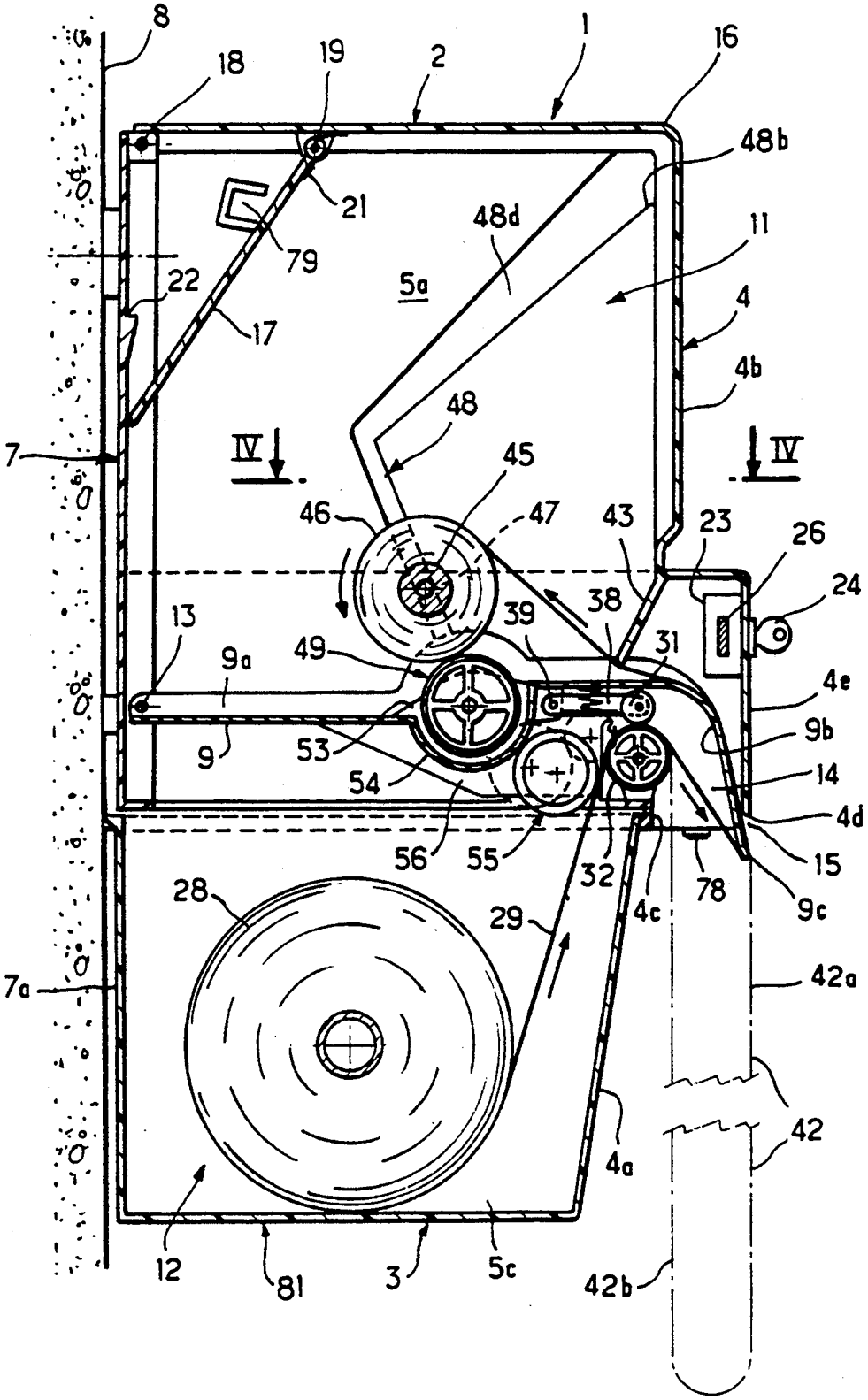
FIG. 2 is a vertical section view on line II—II of FIG. 1.
Figure 3:
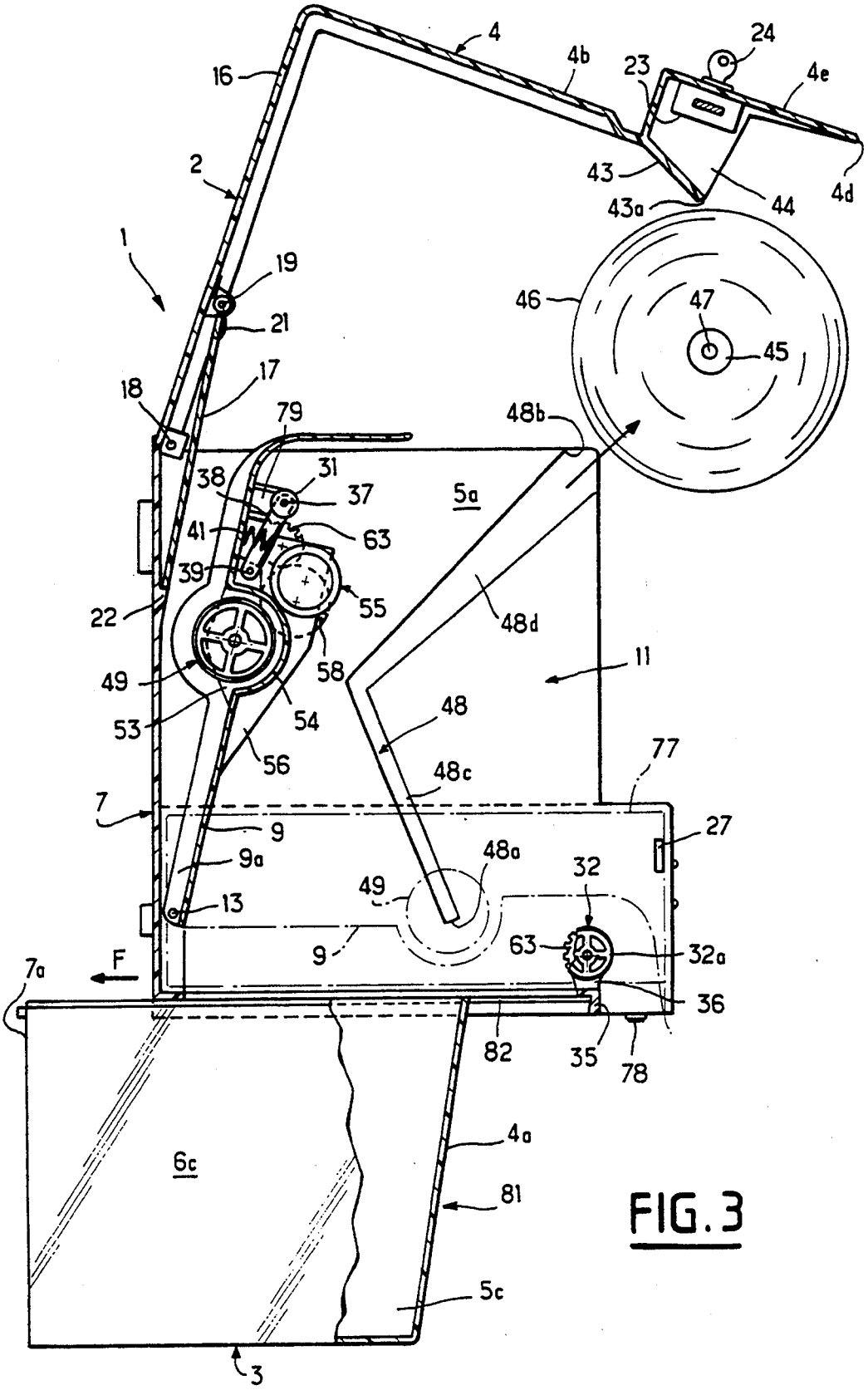
FIG. 3 is another vertical section view of the dispenser, with its cover open for loading a roll of clean towel into the dispenser.

The upper portion 4*b* of the front wall 4 and the top wall 2 of the housing are preferably formed as a single piece, together constituting a movable access part 16 which is fixed to the housing 1 in detachable manner. In the embodiment shown, the movable access part 16 forms a cover which is hinged to the load-carrying structure 5*a*, 6*a*, 7 of the housing via a hinge-forming device 18, which may be similar to the hinge-forming device 13 described above. A prop flap 17 is pivotally mounted to the cover 16 about an axis 19 on the inside thereof. A torsion spring 21 urges said flap 17 towards the rear wall 7 of the housing. When the cover 16 is moved to its open position as shown in FIG. 3, the prop flap 17 cooperates with a projection 22 integrally formed with the rear wall 7 and on the inside thereof, so as to hold the cover 16 in its open position. From this position, the cover 16 can be closed again merely by pulling the flap 17 forwards so as to disengage it from the projection 22, and by causing the cover to pivot clockwise about the hinges 18. The cover 16 may be locked in its closed position as shown in FIG. 2 by means of a lock 23 carried by the upper portion 4*b* of the front wall 4. The lock 23 may be operated by an authorized person by means of a key 24 that can be engaged in a keyhole 25 provided in the front wall 4 of the housing 1. When the key 24 is rotated, it activates two latches 26 that move in opposite directions, and depending on the direction in which the key 24 is rotated, the latches are engaged in or extracted from two catches 27 provided in the plates 5*a* and 6*a*, respectively.

A roll of clean towel 28 is disposed in the lower compartment 12 and rests on the bottom of the housing 1 (bottom wall 3). The strip of clean towel 29 from the roll 28 passes firstly between two feed rollers 31 and 32, making contact with a substantial fraction of the periphery of the lower roller 32. The diameter of the roller 32 is greater than that of the roller 31 and its outside surface is not smooth, for example its surface may be roughened by a layer of emery. The roller 32 may be continuous along its entire length or, as shown in FIG. 4, may be constituted by a series of wheels 32*a* carried by a hexagonal section shaft 33 (FIG. 5) which is supported at its ends in bearings 34 (only one bearing 34 is visible in FIG. 4). The two bearings 34 are themselves supported by a cross-member 35 (FIG. 3) which, in operation, forms the top edge of the lower portion 4*a* of the front wall 4 and which is rigidly fixed to or integrally formed with the two plates 5*a* and 6*a* of the load-carrying structure of the housing 1. Between the wheels 32*a*, the roller 32 is supported by intermediate bearings formed by lugs 36 which project vertically from the cross-member 35. The shaft 33 and thus the roller 32 may be rotated clockwise (as shown in FIGS. 2 and 3) in a manner that is described in detail below.

The roller 31 (visible only in FIGS. 2 and 3) is a presser roller which is attached by means of a resilient suspension beneath the separation partition 9. The roller 31 may be continuous along its entire length, or, like the roller 32, it may comprise a succession of wheels carried by a shaft 37 (FIG. 3) which is itself supported at its ends by two arms 38. Each arm 38 is pivotally mounted about an axis 39 beneath the separation partition 9, and a spring 41 acts on each arm 38 to urge the roller 31 away from the separation partition 9. Thus, in operation, when the separation partition 9 is in the position shown in FIG. 2, the roller 31 is urged resiliently against the roller 32 so as to pinch the strip of towel 29 between them.

As shown in FIG. 2, the extension 9*b* of the separation partition 9 includes a downwardly curved portion which extends substantially vertically at a distance form the periphery of the roller 32, such that the slot 14 formed between said portion of the extension 9*b* and the periphery of the roller 32 is relatively wide, i.e. much wider than the thickness of the strip of towel 29 coming from the roll 28. In this way, when the roller 32 is temporarily rotated clockwise, the strip of towel 29 which is then pulled off the roll 28 by the pair of feed rollers 31 and 32 falls naturally under gravity out from the housing 1 without any obstacle as it goes through the wide slot 14, thus forming a loop as represented by chain-dotted line 42 in FIG. 2.

The extension 9*b* of the separation partition 9 preferably extends downwards to a level below that of the roller 32. In this way, while the dispenser is waiting, ready to be used by a person, and while the strip of towel 29 is tensioned between the roller 32 and the bottom edge 9*c* of the extension 9*b*, the portion of the strip of towel extending between said bottom edge 9*c* and the roller 32 is practically invisible. There is therefore little risk of it being dirtied.

After going round the bottom edge 9*c* of the extension 9*b*, the strip of towel comes back into the housing 1 through the slot 15 formed between the bottom edge 4*d* of the upper portion 4*b* of the front wall 4 and the extension 9*b* of the separation partition 9. As can clearly be seen in FIG. 2, the upper portion 4*b* of the front wall 4 includes a lower portion 4*e* which is offset outwardly and which overlies the downwardly curved portion of the extension 9*b* of the separation partition 9. In the vicinity of its bottom edge 9*c*, the extension 9*b* is preferably slightly curved towards the outside. The bottom edge 4*d* of the said portion 4*e* that is offset towards the outside is preferably situated vertically immediately above the bottom edge 9*c* of the extension 9*b* of the separation partition.

Because of the vertical or substantially vertical disposition of the lower portion of the extension 9*b* of the separation partition 9, said lower portion of the extension 9*b* acts like a separation blade for separating from each other the two pieces 42*a* and 42*b* of the loop 42 formed by the strip of towel when the towel is automatically "swallowed" into the housing 1 through the slot 15 in a manner described below, after the towel has been used by a person for wiping the hands. If the user should accidentally grasp both portions 42*a* and 42*b* for drying the hands, it may happen that the two crumpled-together pieces 42*a* and 42*b* stick together and remain stuck together after being used. Under such circumstances, when the piece 42*a* is pulled into the housing 1 through the slot 15, the lower portion of the extension 9*b* of the partition 9 then acts as a blade for separating the two pieces 42*a* and 42*b* from each other, thereby preventing the towel jamming in the slot 15. This separation action is further reinforced by the fact that the lower portion of the extension 9*b* in the region of its edge 9*c* is curved slightly towards the outside as mentioned above and as can be seen in FIG. 2.

After moving back into the housing 1 through the slot 15, the strip of towel follows the rounded or curved portion of the extension 9*b* of the separation partition 9, and is tensioned by a strip tensioner 43 carried by the upper portion 4*b* of the front wall 4. As shown in FIGS. 2 and 3, the strip tensioning means 43 may be constituted merely by a lip or a rib formed integrally with the upper portion 4*b* of the front wall 4 and projecting obliquely into the housing to a point situated close to the separation partition 9. As shown in FIG. 3, one or more reinforcing ribs 44 may extend between the rib 43 and the outwardly offset portion of the upper portion 4*b* of the front wall 4.

Figure 5:
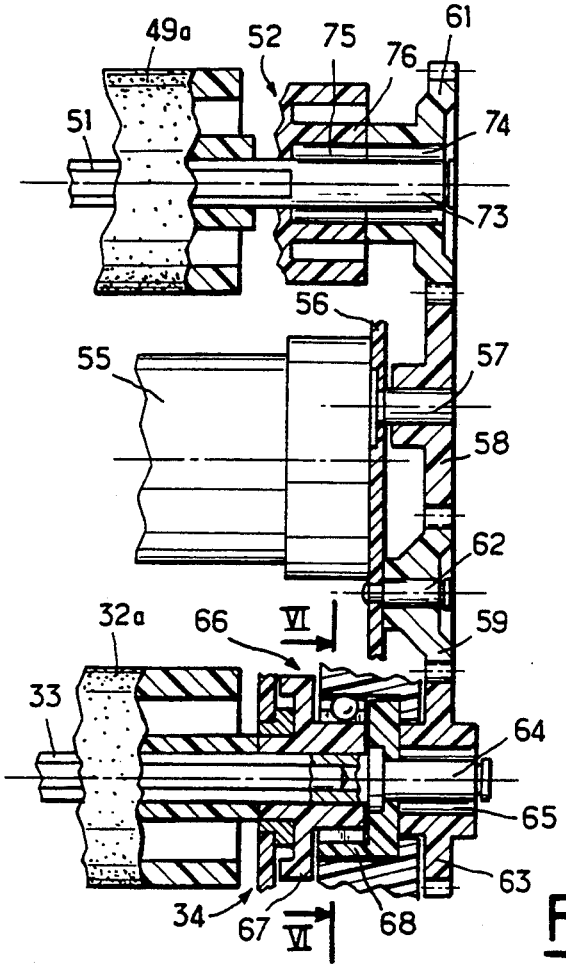
FIG. 5 is a fragmentary view on a larger scale showing the drive mechanism that rotates the towel feed roll and the drive roller that causes the strip of used towel to be wound up.

After going past the bottom edge 43*a* of the tensioning rib or lip 43, the strip of towel 29 is wound around a shaft 45 to form a roll of used towel 46. At each of its ends, the shaft 45 is provided with a stub axle 47 which is mounted free to slide and rotate in a corresponding one of two guide grooves 48 formed in each of the plates 5*a* and 6*a*, respectively. The shaft 45 is thus not directly coupled to a rotary drive mechanism. Instead of that, the strip of used towel is wound into a roll 46 about the shaft 45 by virtue of the fact that the roll 46 is in contact with a drive roller 49 having a peripheral surface that is not smooth. For example, the surface of the roller 49 may be made rough by a layer of emery. Like the feed roller 32, the drive roller 49 may be continuous along its entire length or, as shown in FIG. 4, it may be constituted by a series of wheels 49*a* carried by a hexagonal section shaft 51 (FIG. 5). The ends of the shaft 51 are supported by bearings 52 which are secured to the separation partition 9, and more precisely to the lateral flanges 9*a* thereof. Between the wheels 49*a*, the roller 49 is preferably also supported by intermediate bearings 53 formed by lugs extending vertically from the separation partition 9. The shaft 51, and thus the drive roller 49, can thus be rotated clockwise (as seen in FIG. 2) in a manner that is described in detail below. Under such conditions, when the drive roller 49 is driven clockwise, the roll of used towel 46 is rotated anticlockwise by friction with the rough-surfaced roller 49.

Figure 7:
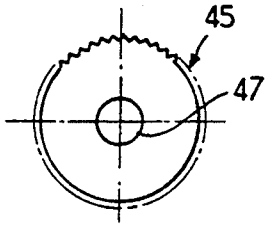
FIG. 7 is an end view of the shaft for winding up the strip of used handtowel.

In order to guarantee proper winding of the strip of used towel about the shaft 45, at least when the roll 46 is beginning to be formed, the shaft 45 is preferably made of heavy material, e.g. of steel or of a metal that is heavier still, and its outside surface is preferably fluted in the longitudinal direction, with flutes that are triangular in section when the shaft 45 is seen end-on, as in FIG. 7.

As can be seen in FIGS. 2 and 3, the separation partition 9 is shaped in such a manner that substantially in the middle thereof, but nevertheless closer to the front wall 4 than to the rear wall 7, there is a kind of trough 54 in which the drive roller 49 is received so that approximately the top half of the roller 49 projects above the top surface of the separation partition 9. Each of two guide grooves 48 has a bottom end 48*a* situated close to the separation partition 9 (when the partition is in the position shown in FIG. 2), and a top end 48*b* which is open and which opens to the outside of the housing 1 when the cover 16 is open to give access to the inside of the upper compartment 11 of said housing. Each guide groove 48 preferably has a lower portion 48*c* and an upper portion 48*d* which extend in two directions that are at an angle to each other. As can be seen more clearly in FIG. 3, the lower portion 48*c* of each groove 48 extends obliquely upwards towards the rear wall 7 of the housing 1, while the upper portion 48*d* extends obliquely upwards towards the front wall 4. At least the open top end 48*b* of each guide groove 48 or, as shown in FIGS. 2 and 3, the entire upper portion 48*d* of each guide groove 48, flares upwardly and outwardly so as to facilitate inserting the stub axles 47 of the shaft 45 when the shaft is put back into place in the dispenser after the roll of used towel 46 has been removed therefrom.

There follows a description of how the rollers 32 and 49 are rotated. Although the rollers 32 and 49 could be driven by separate motors, it is advantageous for reasons of cost and bulk for both of the rollers 32 and 49 to be driven from the same electric motor. However, since the two rollers 32 and 49 are not required to rotate at the same time, precautions must be taken, as explained below, to ensure that the motor does not drive the roller 49 while it is driving the roller 32, and vice versa that it does not drive the roller 32 while it is driving the roller 49.

Figure 6:
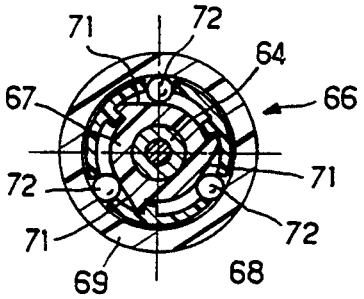
FIG. 6 is a section view on line VI—VI of FIG. 5.

In the particular embodiment shown by way of example in the accompanying drawings, only one electric motor is therefore provided, or more precisely a motor and gear box unit 55. The electric motor of the motor and gear box unit 55 may, for example, be a reversible motor. The unit 55 is preferably supported by and fixed to a vertical support plate 56 which is secured to or integral with the separation partition 9. As can be seen more clearly in FIG. 5, a gear wheel 58 is keyed to the drive shaft 57 of the motor and gear box unit 55, which gear wheel meshes both with an idler toothed wheel 59 and with a toothed wheel 61. The idler toothed wheel 59 is mounted to rotate on a shaft 62 having one of its ends fixed to the support plate 56. When the separation partition 9 is in the position shown in FIG. 2, the idler toothed wheel 59 meshes with another toothed wheel 63 carried by a shaft 64 which is in axial alignment with the shaft 33, but which is capable of rotating relative thereto. A first free-wheel 65 (one-way coupler) is mounted in the hub of the toothed wheel 63 between said wheel and the shaft 64. The free-wheel 65 is disposed to transmit rotary motion from the toothed wheel 63 to the shaft 64 only when said toothed wheel is rotating clockwise (as seen in FIG. 2). The shaft 64 is preferably not directly coupled to the shaft 33, but is coupled thereto via a second free-wheel or one-way coupler 66, as shown in FIGS. 5 and 6. More precisely, the shaft 64 is mounted to be capable of rotating freely within the inner bushing 67 of the free-wheel 66 which is coupled to the shaft 33 so as to be capable of rotating in both directions therewith. The shaft 64 is also rigidly connected to the intermediate bush or cage 68 of the free-wheel 66, while the outer casing 69 of the free-wheel is coaxial with the bearing 34 and is secured to the cross-member 35 which forms a portion of the load-carrying structure of the housing 1. The free-wheel 66 forms a self-locking system which allows transmission to the shaft 33 and thus to the roller 32 from the toothed wheel 63 and the shaft 64 in the clockwise direction (as seen in FIG. 2), but which prevents the roller 32 from rotating in the clockwise direction when the toothed wheel 63 and the shaft 64 are not driven to rotate in the same direction. Such a situation could arise when the strip of towel forms a loop 42 outside the housing should the user exert downwards traction on the piece **42*b* of the loop. The self-locking system formed by the free-wheel 66 then prevents the user from being capable of manually unwinding an additional quantity of towel strip form the roll of clean towel 28. Under such circumstances, the strip of towel would rotate the roller 32 in the clockwise direction (as seen in FIG. 2) by friction and, since the shaft 33 is coupled directly to the inner bush 67 of the free-wheel 66, the ramps 71 thereof urge the balls or rollers 72 of the free-wheel 66 outwardly against the inside surface of the outer casing 69 of the free-wheel, thereby causing jamming that prevents the inner bush 67 from rotating, and thus prevents the shaft 33 and the roller 32** from rotating clockwise.

The toothed wheel 61 is mounted on a shaft 73 which is coaxially aligned with the shaft 51, but which is capable of rotating relative thereto. A free-wheel 74 is disposed in the hub of the toothed wheel 61 between the toothed wheel and the shaft 73. The free-wheel 74 is disposed to transmit rotary motion to the shaft 73 from the toothed wheel 61 only when the toothed wheel 61 rotates clockwise, i.e. only when the drive shaft 57 of the motor and gear box unit 55 and the gear wheel 58 rotate anticlockwise. The shaft 73 is preferably not directly coupled to the shaft 51, but is coupled thereto via another free-wheel 75 which is similar to the free-wheel 66 and whose outer casing 76 is secured to the separation partition 9. The free-wheel 75 forms a self-locking system enabling rotary motion to be transmitted to the shaft 51 and thus to the roller 49 from the shaft 73 when it is rotating clockwise, but which prevents the shaft 51 and the roller 49 from rotating anticlockwise when the shaft 73 is not driven in the clockwise direction or is stationary. Thus, the free-wheel 75 makes it possible to prevent the user from being able to unwind the used towel roll 46 by pulling manually downwards on the length **42*a* of the loop of towel 42 while said loop is hanging outside the housing 1**.

The dispenser of the present invention also includes a sequential control circuit 77 (FIGS. 1 and 3) which may be received, for example, in the gap between the lateral plate **5*a* and the bodywork element 5*b*. The control circuit 77 which may be implemented in the form of a microprocessor electronic circuit, for example, is organized to respond to a starting signal generated by a switch device or a proximity detector which is actuated by a user, e.g. a photocell 78 which is activated when the user engages a hand beneath the righthand end of the forwardly projecting portion of the front wall 4 of the housing 1. When the starting signal is produced by the photocell 78, it starts an operating cycle of the dispenser which runs as follows. The motor and gear box unit 55 is activated so that its drive shaft 57 and the toothed wheel 58 begin by rotating clockwise for a predetermined length of time or so as to perform a predetermined number of revolutions. During this first period, the rotary motion of the toothed wheel 58 in the clockwise direction is transmitted via the toothed wheels 59 and 63, via the free-wheel 65, via the shaft 64 and the free-wheel 66 to the shaft 33 and to the roller 32 which thus also rotate clockwise. The clockwise rotation of the toothed wheel 58 also causes the toothed wheel 61 to rotate anticlockwise, however the rotation of said wheel 61 in the anticlockwise direction is not transmitted to the shaft 73 or the shaft 51 because of the free-wheel 74 which is designed not to transmit rotary motion in the anticlockwise direction. During the predetermined time or the predetermined number of revolutions of the motor and gear box unit 55, the clockwise rotation of the roller 32 has the effect of dispensing a predetermined length of clean towel strip to the outside of the housing 1 from the roll 28, thereby forming the loop 42. Thereafter, the motor and gear box unit 55 is kept stationary during a second predetermined period of time so as to allow the user to wipe the hands on the loop of towel 42. At the end of this second predetermined period of time, the motor and gear box unit 55 is again activated, so as to cause its drive shaft 57 and the toothed wheel 58 to rotate in the anticlockwise direction for a third predetermined period of time or for a predetermined number of revolutions of the motor and gear box unit 55. During this third period of time, the rotary motion of the toothed wheel 58 in the anticlockwise direction is not transmitted to the shaft 33 or to the roller 32 because of the free-wheel 65 which is designed so as not to transmit the rotation of the toothed wheel 63 when it rotates anticlockwise. In contrast, during this third period of time, the toothed wheel 58 rotates the toothed wheel 61 in the clockwise direction and this rotation of the toothed wheel 61 is transmitted by the free-wheel 74, the shaft 73, the free-wheel 75, and the shaft 51 to the roller 49 which therefore also rotates clockwise. The clockwise rotation of the roller 49 has the effect of rotating the roll 46 of used towel anticlockwise. As a result the length 42***a* of the loop of towel is pulled upwards and the loop of towel 42 which was previously hanging outside the housing 1 is swallowed completely into the housing through the slot 15, with the strip of towel being wound onto the roll 46 whose diameter increases with each operating cycle of the dispenser. Each time the roll 46 is rotated by the drive roller 49, the stub axles 47 on the shaft 45 rotate in the guide grooves 48, while also sliding little by little in an upwards direction along said grooves as the diameter of the roll 46 increases. The control circuit 77 for controlling the above-described sequence of operations of the motor and gear box unit 55 is well known and therefore does not require describing in detail. For example, one such circuit is described in European patent application No. 0 330 553.

When the entire roll of clean towel 28 has been used, the roll of used towel 46 can be removed and a new roll of clean towel can be installed in the following manner. The lock 23 is actuated by means of the key 24 by an authorized person to enable the cover 16 to be opened and raised from the position shown in FIG. 2 to the position shown in FIG. 3, where it is held in place by the prop flap 17 and the projection 22. The roll of used towel 46 can then be removed from the dispenser by sliding the stub axles 47 of the shaft 45 upwards along the guide grooves 48 to the open ends 48*b* of said grooves. Thereafter, the separation partition 9 is tilted upwards by being pivoted about the hinges 13 until it occupies the position shown in FIG. 3. One or two retaining catches may be provided to hold the separation partition 9 temporarily in the raised position. The retaining catch(es) may, for example, be constituted by respective flexible tongues 79 cut out in one or both of the plates 5*a* and 6*a*, with the free ends thereof projecting slightly from the inside face of the corresponding plate 5*a* or 6*a*. In addition to its separation function so as to define two compartments 11 and 12 inside the housing 1 respectively for containing the roll of used towel 46 and the roll of clean towel 28, the separation partition 9 thus forms another moving part which, when the cover 16 is open and when it is in its raised position as shown in FIG. 3, gives access to the lower compartment 12 to enable a new roll of clean towel to be placed therein. After being placed in the lower compartment 12, the roll of clean towel 28 is unwound a little and the strip of towel 29 is passed around the drive roller 32. Thereafter the separation partition 9 is returned to the position shown in FIG. 2, and the strip of clean towel 29 is rolled manually at least once around the shaft 45 which has previously had the roll of used towel 46 removed therefrom. The shaft 45 is then inserted in the upper compartment 11 by engaging its stub axles 47 in the two guide grooves 48 and it is lowered until the first turns of towel wound about the shaft 45 come into contact with the peripheral surface of the drive roller 49. Thereafter, it suffices to close the cover 16 and lock it by means of the lock 23 and the key 24, for the dispenser to be ready for further use.

It can also be seen that if a breakdown should occur while the dispenser is in operation and while the roll of clean towel 28 has not been fully used up, it is possible to remove both of the rolls 28 and 46 from the dispenser without it being necessary to unroll either of them completely, and without it being necessary to disassemble one or more normally-fixed parts of the dispenser. This can be done merely by opening the cover 16 as described above, removing the roll 46, then raising the separation partition 9 into the position shown in FIG. 3 so as to be able to take out the partly-used roll 28 of clean towel. The person responsible for maintaining the dispenser can then obtain access easily to the various mechanisms thereof. In this respect, it may be observed that the presser roller 31, the motor and gear box unit 55, the toothed wheels 58, 59, and 61, the free-wheels 74 and 75, and the drive roller 49 are all supported by the separation partition 9, and constitute, together therewith, a subassembly that can be replaced. In the event of a mechanical or of an electrical failure, this subassembly can be replaced by undoing the two hinge-forming bolts 13 and then replacing the faulty subassembly with a new subassembly that is in working order. This greatly simplifies maintenance of the dispenser.

As visible, in particular in FIGS. 2 and 3, in the embodiment of the dispenser described herein, the bottom wall 3 and the lower portions 4*a*, 7*a*, 5*c*, and 6*c* of the four vertical walls of the housing 1 together form a tank 81 whose depth is of the same order of magnitude as the diameter of a roll of clean towel that has not yet been used. The tank 81 is slidably mounted like a drawer in grooves 82 provided in the inside faces of the lower portions of the plates 5*a* and 6*a*. As can be seen in FIG. 3, the tank 81 is designed to be capable of being separated from the housing 1 by sliding in the direction of arrow F, the cross-member 35 preventing the tank 81 from being removed by sliding in the opposite direction. Under such conditions, once the housing 1 has been installed against a support wall 8, the tank 81 can no longer be withdrawn. However, so long as the housing 1 is not fixed against a supporting wall, the tank 81 can be withdrawn and placed inside the upper compartment 11, thereby enabling the dispenser to be stored and/or transported in a configuration of reduced bulk.

Naturally, the embodiment of the dispenser that has been described above and given purely by way of explanatory example is not limiting in any way and numerous modifications can easily be made thereto by the person skilled in the art without going beyond the ambit of the present invention.

Thus, in particular, instead of implementing the lower portion of the housing 1 in the form of a removable tank 81, the plates 5*a* and 6*a*, and the rear wall 7 of the housing may extend integrally to the bottom of the housing 1. In such circumstances, the lower portion 4*a* of the front wall 4 and the bottom wall 3 may be integrally formed as a lower cover which may be pivotally mounted, for example, on the rear wall 7 in the region of the junction between said rear wall and the bottom wall 3, in a manner similar to the cover 16. Under such circumstances, the separation partition 9 may be mounted in a fixed position inside the housing 1 (while nevertheless being easily detachable) and the cross-member 35 which supports the feed roller 32 may be rigidly fixed to the top edge of the lower portion 4*a* of the front wall 4 so that by opening the lower cover now formed by the lower portion 4*a* of the front wall 4 and by the bottom wall 3 of the housing, it is possible to gain access to the lower compartment 12 in order to install a roll of clean towel therein. Naturally, a fastening system must be provided for detachably connecting the lower cover (3, 4*a*) to the housing. Such a fastening system may be constituted by another lock similar to the lock 23 and carried by the portion 4*a*.

I claim:

1. A handtowel dispenser comprising a housing (1) having a top wall (2), a bottom wall (3), and first, second, third and fourth vertical walls (4–7), one of said second, third and fourth vertical walls being designed to be fixed to a vertical support surface (8), a partition wall (9) that separates an inside volume of the housing into an upper compartment (11) and a lower compartment (12), a roll of clean towel (28) disposed in the lower compartment, a pair of co-operating feed rollers (31,32) disposed in the lower compartment and engaging opposite faces, respectively, of a strip of clean towel from said roll of clean towel, first drive means (55, 58, 59, 63, 65, 66) connected to one of the two feed rollers (31,32) for rotating said one feed roller in response to a start signal so as to unwind a predetermined length of clean towel strip (29) from said roll of clean towel and to cause it to pass to the outside of the housing through a first slot (14) therein, take-up means, including a shaft rotatably mounted in the upper compartment, for taking up said strip of towel into the housing through a second slot (15) therein after said strip of towel has been used, and for causing it to be wound about said shaft (45) after a predetermined time lapse from the start signal, the housing (1) including at least one movable access portion (16) which is detachably fixed to the remainder of the housing and which, when detached and moved to an open position, enables the roll of used towel (46) wound around said shaft to be removed and enables a new roll of clean towel (28) to be installed, wherein said first vertical wall of the housing (1) includes a lower portion (4*a*) and an upper portion (4*b*) spaced from said lower portion; the first slot (14) is delimited by a top edge (4*c*) of the lower portion (4*a*) of said first vertical wall (4) and by an extension (9*b*) of the partition wall (9) which projects outside the housing (1), while the second slot (15) is delimited by a bottom edge (14) of the upper portion (4*b*) of said first vertical wall (4) and by said extension (9*b*) of the partition wall (9); said movable access portion (16) is formed at least in part by said upper portion (4*b*) of the first vertical wall (4); the take-up means comprise in addition to said shaft, a drive roller (49) having a non-smooth surface which is rotatably mounted above the partition wall (9), and a motor which is drivingly connected to said drive roller; said shaft (45) is made of a heavy material, is disposed above said drive roller (49) and has its ends slidingly and rotatably mounted in guide grooves (48) which are formed respectively in said second and third vertical walls (5 and 6) of the housing (1), said second and third vertical walls being adjacent to said first vertical wall (4), each of said guide grooves extending substantially vertically in the respective second or third vertical wall and having a lower end adjacent to a respective end of the drive roller (49); and the two feed rollers (31, 32) are located in the first slot (14) and are supported by two separate portions (9, 35) of the housing (1), one of which portions (9) forms another movable access portion that can be displaced from a first position in which, in operation, the two feed rollers (31, 32) are pressed against said opposite faces of the strip of clean towel (29), and a second position in which the two feed rollers (31, 32) are widely spaced apart from each other to give access to the lower compartment (12) of the housing (1).

2. A dispenser according to claim 1, wherein one (32) of the two feed rollers (31, 32) is supported by the partition wall (9) which is mounted movable relative to the housing (1) and forms said other movable access portion, while the other feed roller (32) is mounted in a fixed position in the housing (1) immediately above the top edge (4*c*) of the lower portion (4*a*) of the first vertical wall (4).

3. A dispenser according to claim 2, wherein the partition wall (9) is connected to the housing (1) via a horizontal-axis hinge-forming device (13) situated close to the fourth vertical wall (7) of the housing (1).

4. A dispenser according to claim 1, wherein the motor (55), the drive roller (49), and one of the two feed rollers (31,32) are supported by the partition wall (9) and together therewith form a replaceable assembly.

5. A dispenser according to claim 4, wherein said motor (55) is a motor having two directions of rotation, and is also drivingly connected to the other of said two feed rollers (32) via a first transmission (58, 59, 63, 65, 66) comprising at least two toothed wheels (59, 63) which mesh with each other when the partition wall (9) forming said other movable access portion is in said first position, and a first free-wheel (64) for driving said other feed roller (32) only when the motor (55) rotates in a first direction, said motor being drivingly connected to said drive roller (49) via a second transmission (58, 61, 74, 75) including a second free-wheel (74) for driving the drive roller (49) only when the motor (55) rotates in a direction opposite to the first direction.

6. A dispenser according to claim 5, wherein said extension (9*b*) of the partition wall (9) includes a downwardly curved or rounded portion which extends substantially vertically at a distance from the periphery of said other feed roller (32) and has a bottom edge (9*e*) is situated at a level that is lower than that of said other feed roller (32).

7. A dispenser according to claim 6, wherein the bottom edge (9*c*) of the extension (9*b*) is slightly curved outwardly.

8. A dispenser according to claim 7, wherein said upper portion (4*b*) of the first vertical wall (4) includes a lower portion (4*e*) which is offset outwardly and which overlies the downwardly curved portion of the extension (9*b*) of the partition wall (9), said outwardly offset lower portion having a bottom edge situated vertically above the bottom edge (9*c*) of the extension of the partition wall and co-operating therewith to form said second slot (15).

9. A dispenser according to claim 2, wherein said extension (9*b*) of the partition wall (9) includes a downwardly curved or rounded portion which extends substantially vertically at a distance from the periphery of said other feed roller (32) and has a bottom edge (9*e*) situated at a level that is lower than that of said other feed roller (32).

10. A dispenser according to claim 9, wherein the bottom edge (9*c*) of the extension (9*b*) is slightly curved outwardly.

11. A dispenser according to claim 10, wherein said upper portion (4*b*) of the first vertical wall (4) includes a lower portion (4*e*) which is offset outwardly and which overlies the downwardly curved portion of the extension (9*b*) of the partition wall (9) said outwardly offset lower portion having a bottom edge situated vertically above the bottom edge (9*c*) of the extension of the partition wall (9) and co-operating therewith to form said second slot (15).

12. A dispenser according to claim 1, wherein said upper portion (4*b*) of the first vertical wall (4) carries a strip tensioning means (43) which acts against the strip of towel (29) on its path between the extension (9*b*) of the partition wall (9) and the roll of used towel (49) wound onto said shaft (45).

13. A dispenser according to claim 12, wherein said tensioning means (43) is constituted by a lip or rib that projects obliquely downwards inside the housing (1) from the upper portion (4*b*) of the first vertical wall (4), and which extends to the vicinity of the partition wall (9).

14. A dispenser according to claim 1, wherein each guide groove (48) has a bottom end (48*a*) situated close to the partition wall (9) and a top end (48*b*) which is open and which opens to the outside of the housing (1) when the upper portion (4*b*) of the first vertical wall (4) is moved away to give access to the inside of the housing.

15. A dispenser according to claim 14, wherein each guide groove (48) has a lower portion (48*c*) and an upper portion (48*d*) extending in directions that are at an angle to each other, said lower portion (48*c*) of the groove (48) extending obliquely upwards towards the fourth vertical wall (7) of the housing (1), whereas the upper portion (48*d*) of the groove extends obliquely upwards towards the first vertical wall (4) of the housing (1).

16. A dispenser according to claim 14, wherein the open top end (48*b*) of each guide groove (48) is flared.

17. A dispenser according to claim 1, wherein said shaft (45) has longitudinal fluting.

18. A dispenser according to claim 1, wherein said upper portion (4*b*) of the first vertical wall (4) and the top wall (2) of the housing (1) comprise a single piece forming a cover (16) which is connected to the housing by means of a hinge-forming device (18) which is situated in a top region of the fourth vertical wall (7) of the housing (1).

19. A dispenser according to claim 1, wherein the bottom wall (3) and lower portions (4*a*, 5*c*, 6*c*, and 7*a*) of the first, second, third and fourth vertical walls (4–7) of the housing (1) together form a tank (81) having a depth corresponding to the diameter of an as-yet unused roll of clean towel (28), and the tank (81) is slidably mounted like a drawer beneath the remaining upper portions of the first, second, third and fourth vertical walls of the housing (1).

20. A dispenser according to claim 1, characterized it that the open top end (48*b*) of each guide groove (48) flared.

* * * * *